United States Patent [19]

Yoshida

[11] 4,321,733

[45] Mar. 30, 1982

[54] SLIDE FASTENER STRINGER

[75] Inventor: Hiroshi Yoshida, Kurobe, Japan

[73] Assignee: Yoshida Kogyo K.K., Tokyo, Japan

[21] Appl. No.: 97,430

[22] Filed: Nov. 23, 1979

[30] Foreign Application Priority Data

Dec. 7, 1978 [JP] Japan ..... 53-151855

[51] Int. Cl.[3] ..... A44B 19/10

[52] U.S. Cl. ..... 24/205.16 C; 24/205.1 C; 24/205.13 C

[58] Field of Search ..... 24/205.1 C, 205.16 C, 24/205.16 R, 205.13 C

[56] References Cited

U.S. PATENT DOCUMENTS

| | | | |
|---|---|---|---|
| 3,128,518 | 4/1964 | Steingrübner | 24/205.16 C X |
| 3,436,041 | 4/1969 | Haller | 24/205.13 C |
| 3,456,306 | 7/1969 | Heimberger | 24/205.13 C |
| 3,783,476 | 1/1974 | Fröhlich | 24/205.16 C |
| 3,855,671 | 12/1974 | Fujisaki | 24/205.16 C |
| 4,182,006 | 1/1980 | Yoshida | 24/205.16 C X |
| 4,182,007 | 1/1980 | Yoshida | 24/205.16 C |

FOREIGN PATENT DOCUMENTS

| | | | |
|---|---|---|---|
| 2112296 | 10/1970 | France | 24/205.16 C |
| 1370634 | 10/1974 | United Kingdom | 24/205.16 C |

OTHER PUBLICATIONS

Federal Standard: Stitches, Seams, and Stitchings, Fed. Std. No. 751, Aug. 14, 1959, Stitch Type 101 & 401.

*Primary Examiner*—Roy D. Frazier
*Assistant Examiner*—Peter A. Aschenbrenner
*Attorney, Agent, or Firm*—Bucknam and Archer

[57] ABSTRACT

A slide fastener stringer includes a stringer tape having a pair of opposite surfaces, and a series of fastener elements sewn to the stringer tape on one of the surfaces thereof along its one longitudinal edge by utilizing single thread chain stitches formed with a monofilament thread having a coefficient of thermal contraction. The sewing thread has a succession of loops disposed on the other surface of the tape, each loop being intralooped with a preceding loop of the same thread such that the crossing of these adjacent two loops is disposed between adjacent two of the fastener elements, as viewed in a direction perpendicular to the general plane of the tape. The monofilament thread, after sewn to the tape, is heat-set to shrink and then become dimensionally stable, thereby holding the fastener elements more tightly on the tape.

8 Claims, 10 Drawing Figures

SLIDE FASTENER STRINGER

BACKGROUND OF THE INVENTION

1. Field of the Invention

The present invention relates to a slide fastener stringer including a stringer tape and a series of fastener coupling elements sewn to the tape along one longitudinal edge thereof. The invention also relates to a method of manufacturing such slide fastener stringer.

2. Prior Art

It is known to sew a series of fastener coupling elements to a stringer tape by utilizing single thread chain stitches or multi-thread chain stitches, usually formed with a multifilament yarn or yarns.

Single Thread Chain Stitch is formed with a single needle thread and is quite simple in structure, and hence does not require a sophisticated sewing machine. Using this type of stitch enables the coupling elements to be sewn to the tape with maximum ease with minimum cost. Further, this type of stitch has a high degree of stretchability, which is one of the essential factors for a well workable slide fastener. Despite these advantageous characteristics, single thread chain stitch has not been widely used in sewing the coupling elements to the stringer tape. This is because the sewing thread of this stitch type extends over and around the coupling elements only with a small degree of tightness, and because, in the event the thread is broken, the sewing stitches would easily become loose all the way, thereby allowing the coupling elements to be separated apart from the tape.

With such small degree of tightness of the stitches, firm attachment of the coupling elements to the tape is difficult to achieve. FIG. 10 of the accompanying drawings shows, in transverse cross section, a fragment of a pair of interengaged slide fastener stringers 40,41 of the prior art, in which a pair of rows of coupling elements, 42,43 are sewn to a pair of stringer tapes 44,45, respectively, simply by use of single thread chain stitches. Assuming that the fastener stringer 40,41 are sharply bent in the longitudinal direction such that the top surface (undersurface in this Figure) of the tape 44,45 on which the coupling elements 42,43 are disposed becomes concave, the tape edges with the sewing stitches 47,47 are displaced from the normal position toward respective connecting portions 48,48 of the opposed coupling elements 42,42, i.e. from the phantom line position to the solid line position. For this reason, the prior fastener stringers 40,41 would often accidentally split open when they are bent.

Multi-thread Chain Stitch, which is also known as "Double Locked Stitch", is formed with two or more sewing threads, i.e. needle and looper threads, and has a complicated structure, and hence can prevent the sewing threads from becoming loose all the way even when some of the sewing threads are broken. Using this type of stitch, the coupling elements can be held more stably and firmly in position on the tape. On the other side, multi-thread chain stitch requires an increased amount of sewing thread, as compared with single thread chain stitch, and involves complicated sewing operation which is time-consuming and must be accomplished by a specially designed sewing machine. Moreover, using multi-thread chain stitch necessarily spoils the flexibility of the stringer tape, which is one of the essential factors for a slide fastener product free from accidentally splitting open when subject to bending forces.

In the prior slide fastener stringer, loops of the sewing threads are disposed over those legs of the coupling elements which are remote from the tape, no matter which type of stitch is used. With such arrangement of the thread loops, a slider cannot be moved smoothly along the opposed rows of coupling elements, and hence the sewing threads are liable to be worn out. Ironing is another cause of the breakage of the sewing threads.

SUMMARY OF THE INVENTION

According to the present invention, a series of sewing stitches securing fastener coupling elements to a stringer tape are formed with a needle thread extending across and around every one of the fastener elements on one of opposite surfaces of the tape and passing between every adjacent two of the fastener elements and through the tape. The needle thread has a succession of loops disposed on the other surface of the tape, each of the thread loops being intralooped with a preceding one of the loops such that the crossing of these adjacent two loops is disposed between adjacent two of the fastener elements, as viewed in a direction perpendicular to the general plane of the tape. The needle thread includes a monofilament yarn having a coefficient of thermal contraction. After being sewn to the tape, the needle thread is heat-set to shrink and then become dimensionally stable, thereby holding the fastener elements more stably and firmly on the tape. The crossing of the adjacent two loops is recessed in the other surface of the stringer tape, and the sewing thread is prevented from being worn out due to sliding movement of a slider.

It is an object of the present invention to provide a slide fastener stringer having a series of coupling elements supported stably and firmly on a stringer tape.

Another object of the invention is to provide a slide fastener stringer which has a sufficient degree of flexibility and hence can be kept from accidentally splitting apart from a companion stringer when the coupled stringers are bent in either direction.

Still another object of the invention is to provide a slide fastener stringer having a series of coupling elements sewn to a stringer tape firmly by utilizing single thread chain stitches which are free from becoming loose when the only sewing thread is broken.

A further object of the invention is to provide a slide fastener stringer which can be manufactured less costly.

Many other advantages, features and additional objects of the present invention will become manifest to those versed in the art upon making reference to the detailed description and the accompanying drawings in which preferred structural embodiments incorporating the principles of the present invention are shown by way of example.

DETAILED DESCRIPTION OF THE PREFERRED EMBODIMENTS

Figure 1:
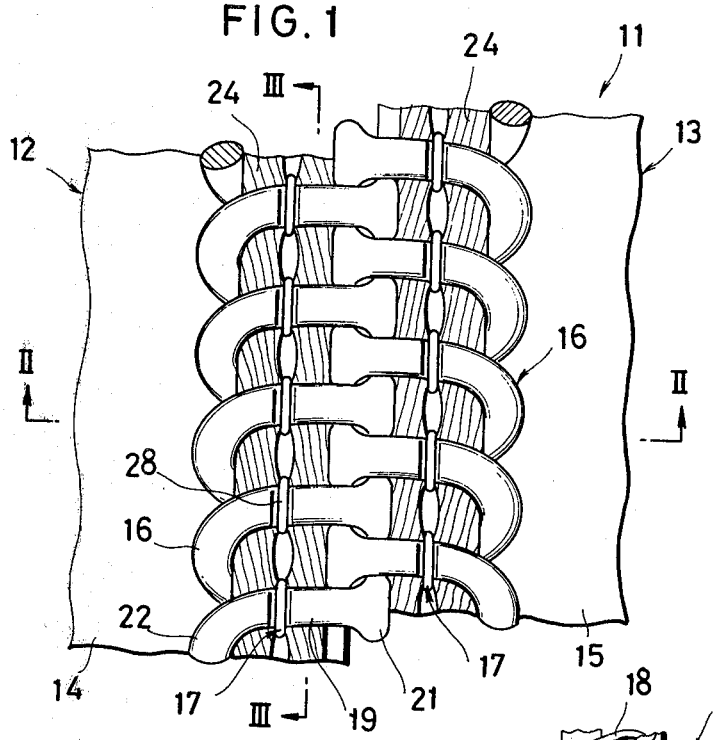
FIG. 1 is a fragmentary top plan view of a pair of slide fastener stringers embodying the present invention.

The principles of the present invention are particularly useful when embodied in a slide fastener assembly (hereinafter referred to as "slide fastener") such as shown in FIGS. 1–4, generally indicated by the numeral 11.

The slide fastener 11 comprises a pair of fastener stringers 12,13 including a pair of stringer tapes 14,15, respectively, each supporting on and along its one longitudinal edge a series of fastener elements or convolutions 16 in the form of a continuos filamentary coil made of a synthetic resin. Each series of coupling elements 16 is secured to the tape 14,15 by means of a series of sewing stitches 17. The type of stitch used is a so-called Single Thread Chain Stitch, which is formed with a single needle thread 18. Each of the coupling elements 16 has a pair of spaced upper and lower legs 19,20, and a head portion 21 extending therebetween. The lower leg 20 of each element is disposed on the top surface 23 (FIGS. 2 and 3) of the stringer tape 14,15 and is connected to the upper leg 19 of a preceding or succeeding one of the elements 16 by a connecting portion 22, the upper leg 19 being spaced apart from the same tape surface 23. A core 24 in the form of a textile cord extends longitudinally through the series of coupling elements 16 and is held by a suitable means (not shown) against the connecting portions 22 in the interior of the coupling elements 16.

The needle thread 18 includes a monofilament yarn made of a synthetic resin, e.g. nylon, polyester, which has a coefficient of thermal contraction (preferably a great coefficient of thermal contraction).

Figure 2:
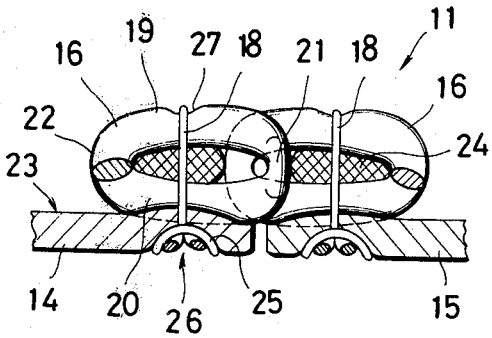
FIG. 2 is a cross-sectional view taken along line II—II of FIG. 1.
Figure 3:
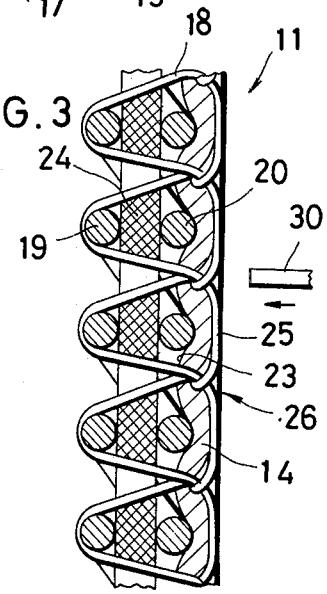
FIG. 3 is a cross-sectional view taken along line III—III of FIG. 1, with a tip end portion of an ultrasonic welder schematically shown.
Figure 4:
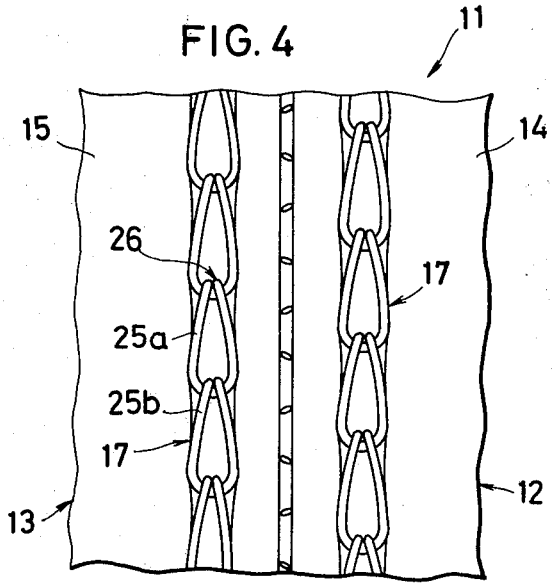
FIG. 4 is a bottom plan view of the slide fastener stringers of FIG. 1, showing a pair of series of stitch loops.
Figure 5:
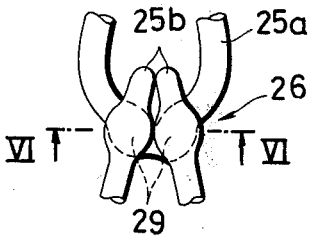
FIG. 5 is a detailed view of the stitch loops of FIG. 4, showing the crossing of adjacent two loops.

As best shown in FIG. 3, the needle thread 18 extends across and around every one of the upper legs 19 on one side or topside (left side in this Figure) of the stringer tape 14,15, and passes between every adjacent two of the coupling elements 16 and through the tape 14,15. The needle thread 18 has a succession of loops 25 disposed on the other side or underside (right side, as viewed in FIG. 3) of the tape 14,15, each of the loops 25 passing through or being intralooped with a preceding one of the loops such that these adjacent two loops 25*a*,25*b* (FIGS. 4 and 5) cross each other at a point 26 disposed between adjacent two of the coupling element 16, as viewed in a direction perpendicular to the general plane of the tape 14. The crossing 26 of adjacent two loops 25*a*,25*b* is recessed in the undersurface of the stringer tape 14,15, as shown in FIGS. 2 and 3, so that the needle thread 18 can be kept from being worn out by a slider (not shown) at the underside of the tape 14,15.

Each of the upper element legs 19 has on its upper surface a transversely extending recess 27 (FIG. 2), in which a portion 28 (FIG. 1) of the needle thread 18 is received, as the latter passes across and over that upper leg 19, so as not to impede the slider from moving smoothly along the opposed rows of coupling elements 16 for opening and closing the slide fastener 11. This prevents the needle thread 18 not only from being easily worn out due to sliding movement of the slider, but also from being accidentally displaced on the coupling elements 16. In the described embodiment, these recesses 27 of the upper element legs 19 are formed as the latter are depressed on their respective upper surfaces by the needle thread 18 which shrinks to be tighten with a great degree of strength during heat-setting process discussed below. Alternatively, the upper element legs 19 may be originally provided with such recesses or grooves.

Figure 6:
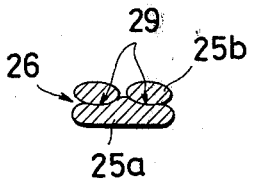
FIG. 6 is a cross-sectional view taken along line VI—VI of FIG. 5.

In production, a row of the fastener coupling elements 16 is sewn to the stringer tape 14,15 on and along its one longitudinal edge by utilizing "chain stitches" formed with a needle thread 18 consisting of a monofilament yarn having a coefficient of thermal contraction (preferably a great coefficient of thermal contraction). Then, the needle thread 18 is heat-set by use of ultrasonic waves or by simply applying heat, as well known in the art. At that time, because of its coefficient of thermal contraction, the monofilament thread 18 shrinks so as to bring the crossing 26 of adjacent two stitch loops 25 slightly into a space between adjacent two of the lower element legs 20, thereby tightening the coupling elements 16 on the tape 14,15 with an increased degree of strength. The needle thread 18 is then cooled to room temperature to become rigid and to be kept dimensionally in stable. This causes the coupling elements 16 to be held more stably in the position shown in FIGS. 2 and 3, there being flattened loop portions 29 (FIGS. 5 and 6) at the crossing 26 of the adjacent loops 25*a*,25*b*. Because of an enlarged area of frictional surfaces, the flattened loop portions 29 serve to resist the sewing stitches 17 from becoming loose all the way when the thread 18 is broken.

In order to keep the sewing stitches 17 more reliably from becoming loose, the adjacent two stitch loops 25*a*,25*b* may be welded at their crossing 26 by a conventional welder 30 (only a tip end portion of which is illustrated diagrammatically in FIG. 3) which is designed to apply heat or ultrasonic waves.

With this arrangement, the sewing thread 18 can be kept from being worn out or broken due to frictional movement of a slider or iron (not shown), not only because the thread 18 consists of a monofilament yarn which is by nature highly protective against abrasion, but also because the portions 28 of the thread 18 are received in the recesses 27 of the upper element legs 19 on the topside of the tape 14,15 and the stitch loops 25 of the thread 18 are recessed in the undersurface of the tape 14,15. Further, because the sewing stitches 17 have a very simple structure and occupy only a small area between adjacent two fastener elements 16, there is little chance that the thread 18 is broken by a sewing needle (not shown) as the latter penetrates through the fastener stringer 12,13 at the inter-element space for attaching the slide fastener 11 onto a garment (not shown).

Figure 8:
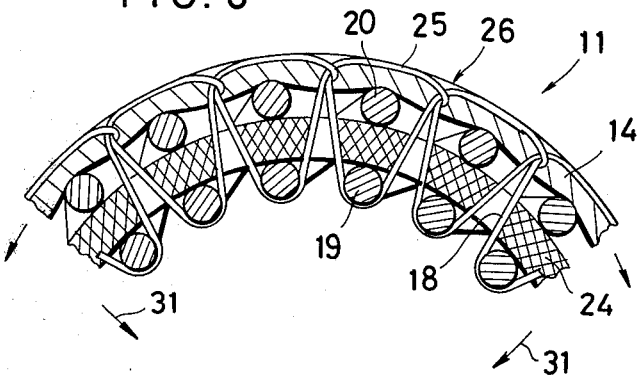
FIG. 8 is a view similar to FIG. 3 but showing the state of the slide fastener stringer as it is being bent.
Figure 9:
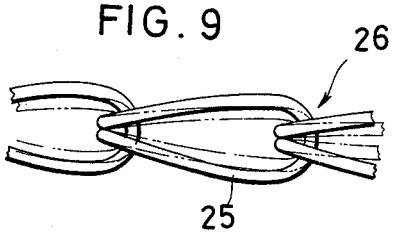
FIG. 9 is an enlarged view of a fragment of the stitch loops of FIG. 8, showing the manner in which the shape of the individual loops is changed as the fastener stringer is bent.
Figure 10:
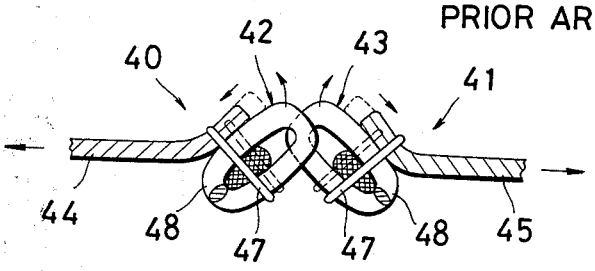
FIG. 10 PRIOR ART
FIG. 10 is a transverse cross-sectional view of a conventional slide fastener as it is being bent.

Moreover, the slide fastener 11 according to the present invention has a sufficient degree of flexibility and can be thereby prevented from accidentally splitting open when bending forces are applied on the slide fastener 11 in the directions indicated by arrows 31 (FIG. 8), at which time the individual stitch loops 25 are transformed from its solid line shape into its phantom line shape, as shown in FIG. 9.

Figure 7:
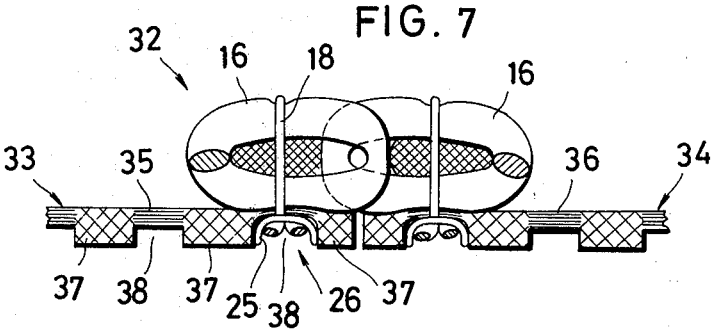
FIG. 7 is a view similar to FIG. 2 but showing another embodiment.

FIG. 7 shows a modified slide fastener 32. The slide fastener 32 includes a pair of fastener stringers 33,34 each having a stringer tape 35,36 which is warp-knitted so as to have on its underside a plurality of laterally spaced wales 37 and hence inter-wale grooves 38. At the underside of each tape 35,36, the stitch loops 25 of the thread 18 with their crossing are received within one of the inter-wale grooves 38. With this arrangement, it is possible to prevent the needle thread 18 more reliably from being worn out or broken by a slider (not shown).

Although various minor modifications may be suggested by those versed in the art, it should be understood that I wish to embody within the scope of the patent warranted thereon all such embodiments as reasonably and properly come within the scope of my contribution to the art.

What is claimed is:

1. A slide fastener stringer comprising:

(a) a stringer tape having a pair of opposite surfaces;

(b) a series of fastener elements each having a pair of spaced legs, one of said legs of each said fastener element being disposed on one of said surfaces of said stringer tape along its one longitudinal edge;

(c) a series of sewing stitches securing said fastener elements to said stringer tape, said sewing stitches being formed with a needle thread extending across and around every one of said fastener elements on said one surface of said tape and passing between every adjacent two of said fastener elements and through said tape, said needled thread having a succession of loops disposed on the other surface of said tape, each of said loops being intralooped with a preceding one of said loops such that a crossing of these adjacent two loops is disposed between adjacent two of said fastener elements, as viewed in a direction perpendicular to the general plane of said tape; and (d) said needle thread including a thermally contractible monofilament yarn, said needle thread, after being sewn to said tape, being heat-set to shrink by thermal contraction and then become dimensionally stable, said crossing of each adjacent two loops being recessed in said other surface of said tape and located below the general plane of said other surface of the tape to thereby hold said fastener elements more tightly on said tape, there being flattened loop portions at said crossing of each adjacent two loops to thereby provide an enlarged area of frictional surfaces which serves to resist said sewing stitches from becoming loose all the way when said needle thread is broken, the other leg of each said fastener elements having in its surface remote from said tape a transversely extending recess in which a portion of said needle thread is received, said recesses being formed as said other legs are depressed on said surfaces by said needle thread, said crossing of each adjacent two loops being brought into a space between adjacent two of said one legs of the fastener elements, each of said adjacent two loops being welded at one of said crossings.

2. A slide fastener stringer according to claim 1, said adjacent two loops being welded together at said crossing thereof.

3. A slide fastener stringer according to claim 1, said stringer tape having a plurality of longitudinally extending interwale grooves in said other surface of said tape, said loops of said needle thread being disposed in one of said interwale grooves.

4. A slide fastener stringer according to claim 1, each of said fastener elements having in its surface remote from said tape a transversely extending recess through which said needle thread passes.

5. A method of manufacturing a slide fastener stringer including a stringer tape having a pair of opposite surfaces, and a series of fastener elements each having a pair of spaced legs, one of said legs of each said fastener element being disposed on one of said surfaces of said stringer tape along its one longitudinal edge, said method comprising the steps of:

(a) placing said fastener elements on said one surface of said tape along said one longitudinal edge thereof;

(b) attaching said fastener elements to said stringer tape by a series of sewing stitches formed with a needle thread including a thermally contractible monofilament yarn, said needle thread extending across and around every one of said fastener elements on said one surface of said tape and passing between every adjacent two of said fastener elements and through said tape, said needle thread having a succession of loops disposed on the other surface of said tape, each of said loops being intralooped with a preceding one of said loops such that a crossing of these adjacent two loops is disposed between adjacent two of said fastener elements, as viewed in a direction perpendicular to the general plane of said tape;

(c) thereafter, heat-setting said needle thread to cause the same to shrink by thermal contraction and then become dimensionally stable, whereby said crossing of each adjacent two loops is recessed in said other surface of said tape and located below the general plane of said other surface of the tape to thereby hold said fastener element more tightly on said tape, there being flattened loop portions at said crossing of each adjacent two loops to thereby provide an enlarged area of frictional surfaces which serves to resist said sewing stitches from becoming loose all the way when said needle thread is broken, the other leg of each said fastener element having in its surface remote from said tape a transversely extending recess in which a portion of said needle thread is received, said recesses being formed as said other legs are depressed on said surfaces by said needle thread, said crossing of each adjacent two loops being brought into a space between adjacent two of said one legs of the fastener elements; and (d) welding each of said adjacent two loops at one of said crossings thereof.

6. A method according to claim 5, further including the step of welding said adjacent two loops at said crossing thereof.

7. A method according to claim 6, the welding of said adjacent two loops being performed by applying heat.

8. A method according to claim 6, the welding of said adjacent two loops being performed by applying ultrasonic waves.

* * * * *